US009837747B2

(12) United States Patent
Tadepalli

(10) Patent No.: US 9,837,747 B2
(45) Date of Patent: Dec. 5, 2017

(54) BURN-IN SOCKET FOR PACKAGED INTEGRATED CIRCUITS

(71) Applicant: Texas Instruments Incorporated, Dallas, TX (US)

(72) Inventor: Ramana Tadepalli, McKinney, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 15/273,818

(22) Filed: Sep. 23, 2016

(65) Prior Publication Data

US 2017/0279211 A1 Sep. 28, 2017

Related U.S. Application Data

(60) Provisional application No. 62/311,957, filed on Mar. 23, 2016.

(51) Int. Cl.
*H01R 13/24* (2006.01)
*H01R 33/74* (2006.01)

(52) U.S. Cl.
CPC ..... *H01R 13/24* (2013.01); *H01R 33/74* (2013.01)

(58) Field of Classification Search
CPC ..... H01R 12/714
USPC ..... 439/73, 331; 324/750.05, 756.02
See application file for complete search history.

(56) References Cited

U.S. PATENT DOCUMENTS 5,049,813 A * 9/1991 Van Loan ..... G01R 31/316 324/754.14
5,435,733 A * 7/1995 Chernicky ..... H05K 3/325 324/762.06
5,500,606 A * 3/1996 Holmes ..... G01R 1/07335 324/754.08
6,188,230 B1 * 2/2001 Birk ..... G01R 1/0416 324/756.05
6,297,654 B1 * 10/2001 Barabi ..... G01R 1/0433 324/756.02
6,359,452 B1 * 3/2002 Mozzetta ..... G01R 1/0408 324/750.25
7,262,615 B2 * 8/2007 Cheng ..... G01R 1/0483 324/756.05
7,598,756 B2 * 10/2009 Inoue ..... G01R 1/0483 324/754.03
7,696,767 B2 * 4/2010 Inoue ..... G01R 1/0483 324/756.07
7,737,710 B2 * 6/2010 Cho ..... G01R 1/0483 257/48
7,768,284 B2 * 8/2010 Groeninger ..... G01R 1/0466 324/762.01

(Continued)

*Primary Examiner* — Ross Gushi
(74) *Attorney, Agent, or Firm* — Tuenlap D. Chan; Charles A. Brill; Frank D. Cimino

(57) ABSTRACT

An integrated circuit burn-in socket with a spring-loaded contact pin built into the socket base and an electrical receptacle built into the socket lid wherein the electrical receptacle is configured to mate with the spring-loaded contact pin when the burn-in socket is closed. In one implementation, the socket lid is separate from the socket base and with a spring-loaded contact pin built into the socket base and with an electrical receptacle built into the socket lid wherein the electrical receptacle is configured to mate with the spring-loaded contact pin when the socket lid is clamped to the socket base.

8 Claims, 10 Drawing Sheets

(56) References Cited

U.S. PATENT DOCUMENTS

| | | | | |
|---|---|---|---|---|
| 8,242,794 | B2 * | 8/2012 | Cho | G01R 1/0483 257/48 |
| 8,603,840 | B2 * | 12/2013 | Matsuhashi | G01R 1/0466 257/E21.002 |
| 8,647,976 | B2 * | 2/2014 | Song | G01R 31/2884 257/737 |
| 9,196,983 | B2 * | 11/2015 | Saur | H01R 12/515 |
| 9,459,281 | B2 * | 10/2016 | Cho | G01R 1/0483 |
| 2009/0151988 | A1 * | 6/2009 | Lee | H05K 1/0218 174/254 |
| 2013/0021052 | A1 * | 1/2013 | Johnson | G01R 31/2887 324/756.02 |

* cited by examiner

BURN-IN SOCKET FOR PACKAGED INTEGRATED CIRCUITS

CROSS-REFERENCE TO RELATED APPLICATIONS

Under 35 U.S.C. §119(e), this application claims the benefit of and priority to U.S. Provisional Application 62/311,957, filed on Mar. 23, 2016, the entirety of which is hereby incorporated herein by reference.

FIELD

This disclosure relates to the field of integrated circuit testing. More particularly, this disclosure relates to burn-in sockets for integrated circuit testing.

BACKGROUND

Burn-in sockets with active thermal control are often used for accelerated reliability testing of packaged integrated circuits.

A packaged integrated circuit such as a dual inline packaged IC (DIP), a packaged IC with ball bonds (BGA), or a Quad Flat No Lead packaged IC (QFN) may be plugged into the burn-in socket. The burn-in socket may then be closed to bring a heater into contact with the packaged integrated circuit to perform accelerated thermal cycling reliability testing.

SUMMARY

An integrated circuit burn-in socket with a spring-loaded contact pin built into the socket base and an electrical receptacle built into the socket lid wherein the electrical receptacle is configured to mate with the spring-loaded contact pin when the burn-in socket is closed. A clam-shell integrated circuit burn-in socket with a spring-loaded contact pin built into the socket base and an electrical receptacle built into the socket lid wherein the electrical pad is configured to mate with the spring-loaded contact pin when the clam-shell burn-in socket is closed. An integrated circuit burn-in socket where the socket lid is separate from the socket base and with a spring-loaded contact pin built into the socket base and with an electrical receptacle built into the socket lid wherein the electrical receptacle is configured to mate with the spring-loaded contact pin when the socket lid is clamped to the socket base. An integrated circuit burn-in socket with a spring-loaded contact pin built into the socket lid and an electrical receptacle built into the socket base wherein the electrical receptacle is configured to mate with the spring-loaded contact pin when the burn-in socket is closed.

DETAILED DESCRIPTION

The present disclosure are described with reference to the attached figures. The figures are not drawn to scale and they are provided merely to illustrate the disclosure. Several aspects of the embodiments are described below with reference to example applications for illustration. It should be understood that numerous specific details, relationships, and methods are set forth to provide an understanding of the disclosure. The present disclosure is not limited by the illustrated ordering of acts or events, as some acts may occur in different orders and/or concurrently with other acts or events. Furthermore, not all illustrated acts or events are required to implement a methodology in accordance with the present disclosure.

Figure 1:
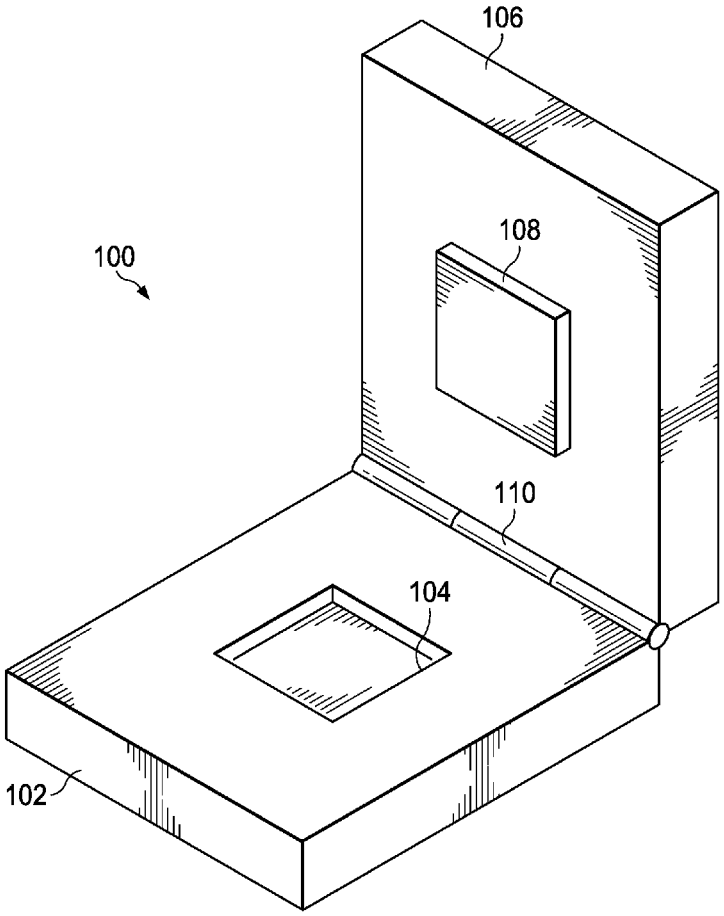
FIG. 1 is a front view of an integrated circuit clam-shell burn-in socket in an open position.
Figure 2:
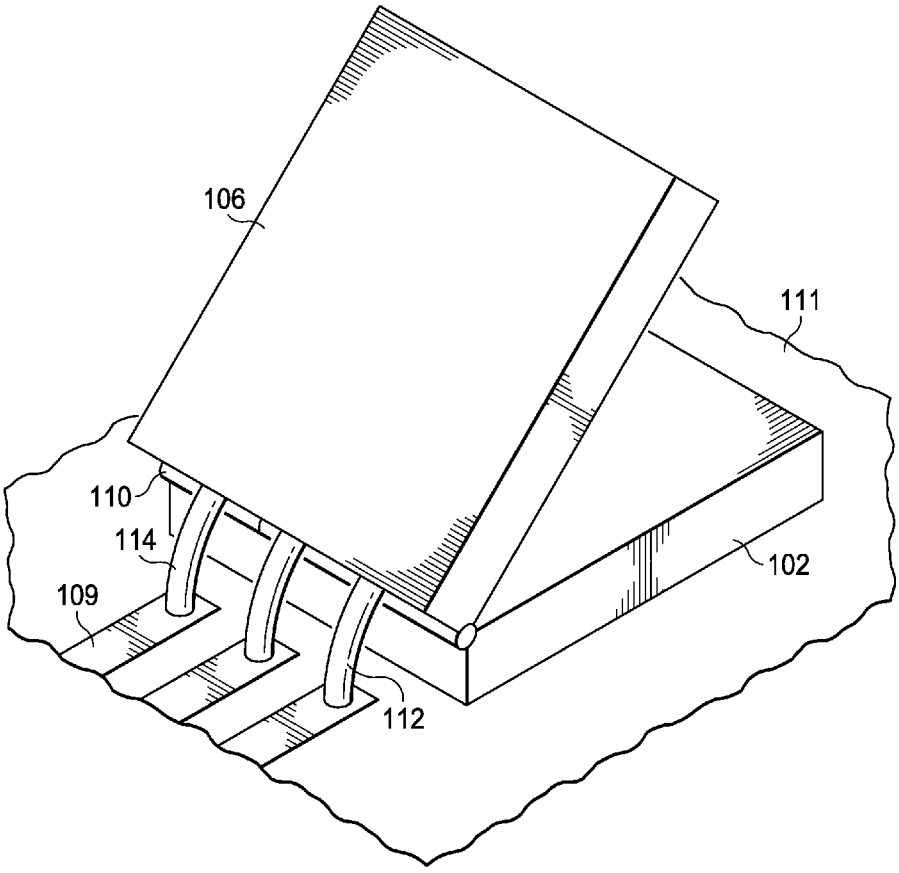
FIG. 2 is a backside view of an integrated circuit clam-shell burn-in socket.

A burn-in socket 100 is illustrated in FIG. 1 and FIG. 2. This burn-in socket 100 is a clam shell type burn-in socket with the lid 106 connected to the base 102 with a hinge 110. The burn-in socket 100 is mounted on a circuit board 111.

Flexible heater wires 114 connect the heater 108 in the lid 106 to power and ground leads 109 on the circuit board 111. A flexible wire 112 may also connect a heater thermocouple in the lid 106 to the circuit board 111 to enable temperature measurement and thermal feedback control. During several test conditions, the flexible wires 112 and 114 may be damaged, thereby impacting the reliability of the overall burn-in socket 100.

More specifically, the flexible wire connections 112 and 114 used in the socket 100 (as shown in FIG. 2) may be subject to temperature cycling during burn-in testing and repeated flexing stress during the opening and closing of the socket 100. The repeated temperature cycling and repeated flexing of the flexible wire connections 114 and 112 may result in wire fatigue and wire breakage.

In addition, the flexible wires, 112 and 114, are external to the burn-in socket 100 and may be damaged by being struck against objects when the burn-in board is being loaded into or unloaded from testing equipment such as a burn-in oven.

To address the reliability issues caused by the flexible wires 112 and 114, spring-loaded contact pins are used on electrical testers to provide electrical connection to probe pads on circuit boards and packaged integrated circuits (IC). Examples of spring-loaded contact pins are shown in FIGS. 3, 4, and 5.

Figure 3:
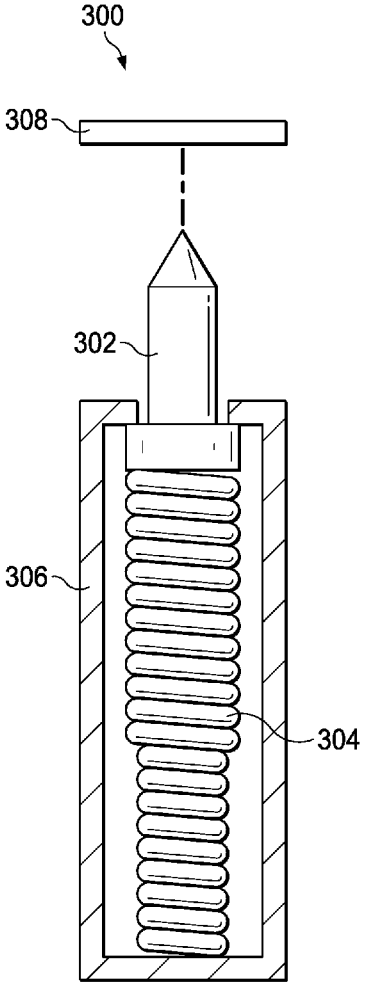
FIG. 3 is an example spring-loaded contact pin for bond pads.

FIG. 3 shows a spring-loaded contact pin 300 used to electrically contact an electrical pad 308 such as a probe pad on an IC. When the probe pad 308 comes into contact with pin 302, the spring 304 is compressed and the pin 302 is partially pushed into the cylindrical housing 306 providing reliable electrical connection during repeated usage.

Figure 4:
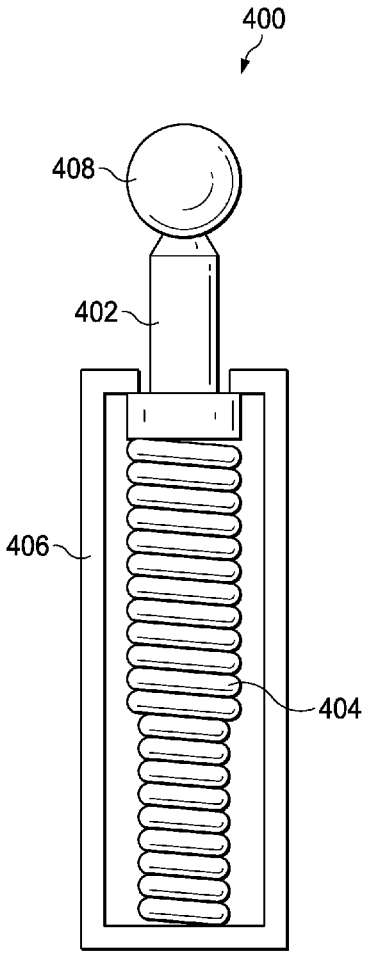
FIG. 4 is an example spring-loaded contact pin for ball bonds.

FIG. 4 shows a spring-loaded contact pin 400 used to electrically contact a ball bond 408 on an IC. When the ball bond 408 comes into contact with pin 402, the spring 404 is compressed and the pin 402 is partially pushed down into the cylindrical housing 406.

Figure 5:
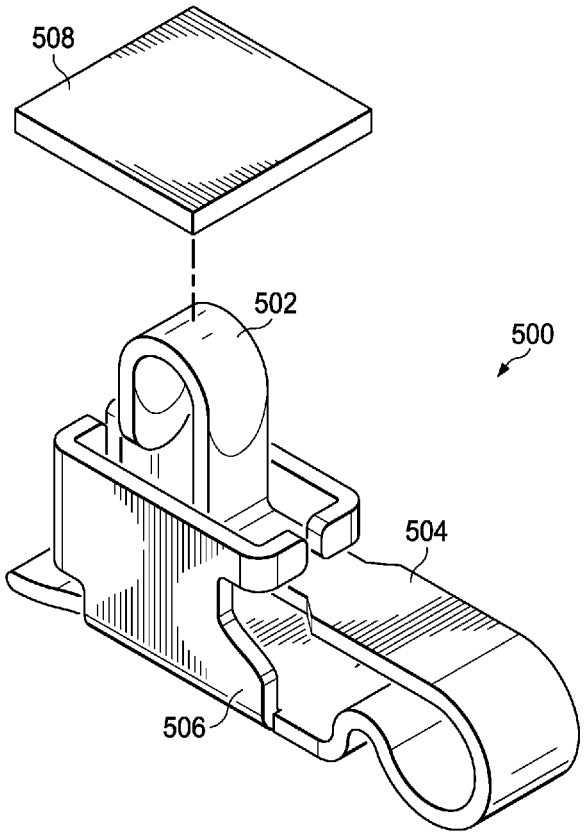
FIG. 5 is an example spring-loaded contact pin for electrical pads.

FIG. 5 shows a spring-loaded electrical contact 500 used to electrically contact an electrical pad 508 such as a probe pad on an IC. When the probe pad 508 comes into contact with the electrical contact 502 portion of the spring-loaded electrical contact 500, spring 504 is compressed and the electrical contact 502 is partially compressed into the housing 506 of the spring-loaded electrical contact 500.

In general, burn-in sockets are expected to go through tens of thousands of use cycles. Because spring-loaded contact pins are in the 100's of thousands of use cycles, they improves the reliability of burn-in sockets by rendering these sockets wire-free, thereby reducing the reliability risks associated with the flexible wire configurations (e.g., 112 and 114).

Figure 6:
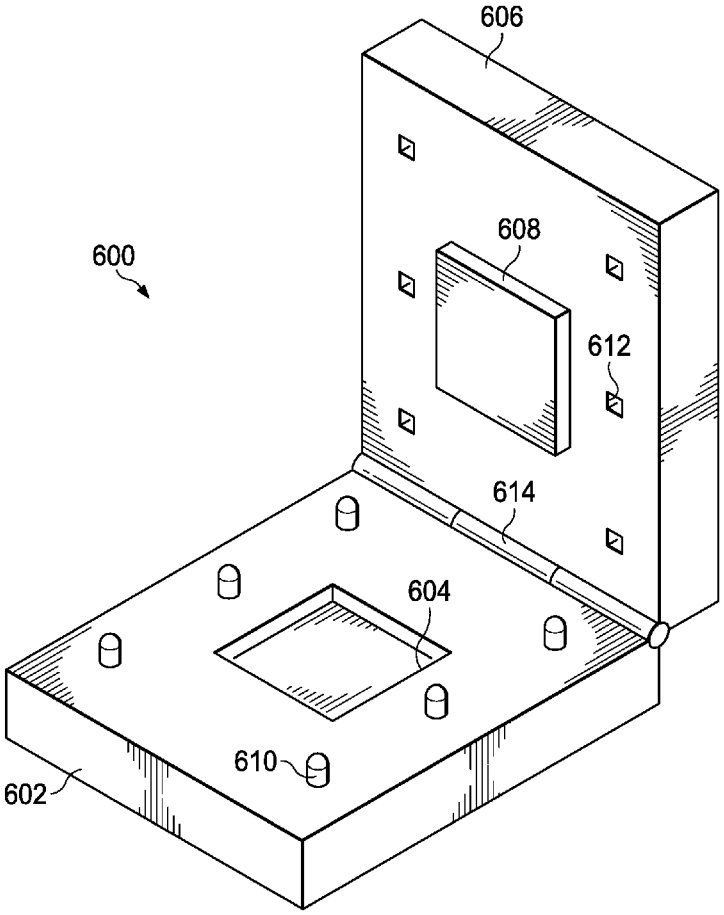
FIG. 6 is view of a clam shell integrated circuit burn-in socket formed according to the principles of the disclosure and displayed in an open position.

According to an aspect of the present disclosure, for example, a wire-free clam shell burn-in socket 600 is depicted in FIG. 6. The burn-in socket 600 provides electrical power to the lid mounted heater 608 using spring-loaded contact pins 610 built into the base 602 and electrical receptacles 612 (which may also include electrical contact pads) built into the lid 606. The spring-loaded contact pins 610 built into the socket base 602, mate with the electrical receptacles 612 in the socket lid 606 when the burn-in socket 600 is closed. Examples of spring loaded contact pins are illustrated in FIGS. 3 and 5. Other spring loaded contact pin designs may alternatively be used. The spring-loaded contact pins 610 avoid the need for flexible wires to bypass the hinge 614. The avoidance of flexible wire connections significantly improves the reliability of the burn-in socket 600. The spring-loaded contact pin 610 electrical connections significantly reduce operating costs by reducing replacement cost, by reducing down time of burn-in circuit boards during replacement of failed burn-in sockets, and by reducing the cost of the labor needed to replace failed burn-in sockets.

In addition, since the spring-loaded contact pins 610 are internal to the burn-in socket 600, the spring-loaded contact pins 610 are not susceptible to damage incurred by being struck against objects when the burn-in board is being loaded into or unloaded from testing equipment such as a burn-in oven.

Figure 7:
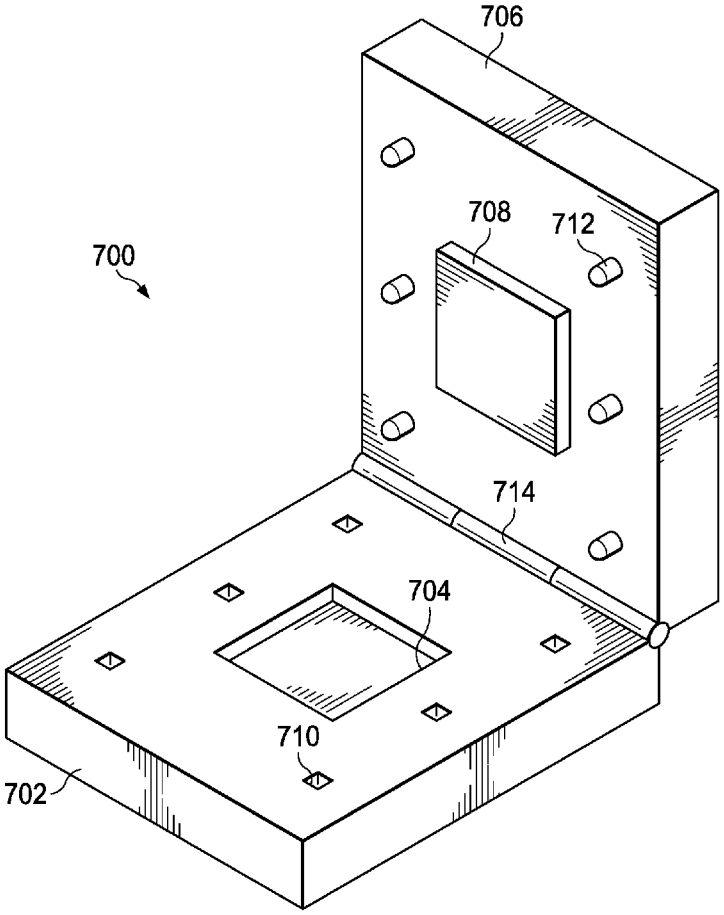
FIG. 7 is view of a clam shell integrated circuit burn-in socket formed according to the principles of the disclosure and displayed in an open position.

Alternatively as shown in FIG. 7, the spring-loaded contact pins 712 may be built into the lid 706 of the burn in socket 700 and the electrical pads or receptacles 710 may be built into the base 702.

Automated Test Equipment (ATE) usage data shows that the embodiment reliable burn-in socket 600 with spring-loaded contact pins 610 is in the range of one to two orders of magnitude more reliable than burn-in sockets 100 with flexible wires, 112 and 114 (FIG. 1 and FIG. 2).

Figure 8A:
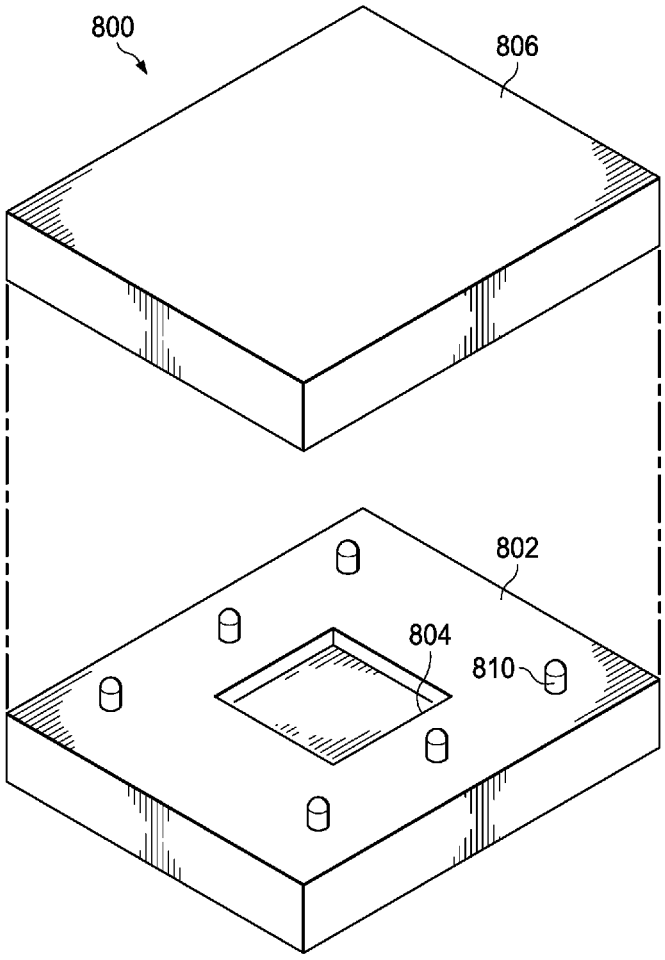
FIGS. 8A, 8B, and 8C are views of an integrated circuit burn-in socket formed according to the principles of the disclosure and displayed in an open position.
Figure 8B:
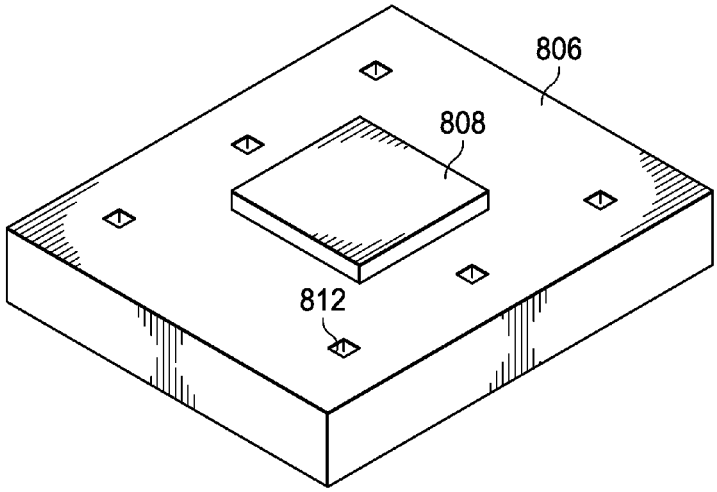
Figure 8C:
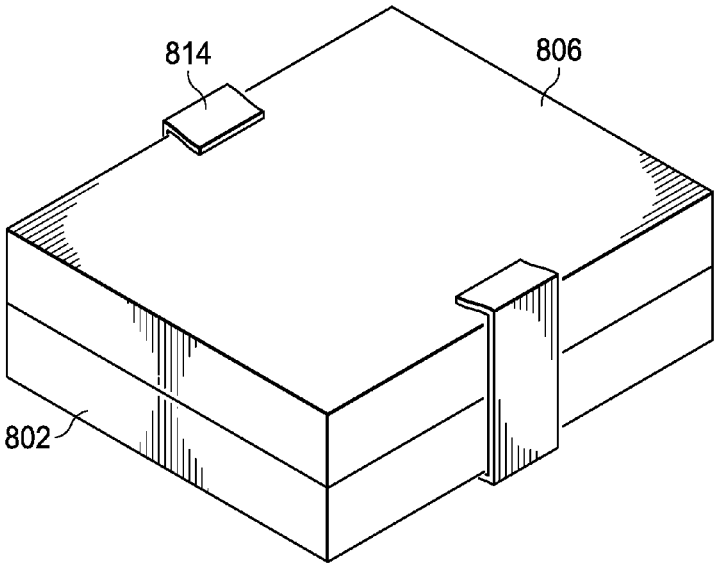

An alternative reliable burn-in socket 800 is illustrated in FIGS. 8A, 8B, and 8C. In this burn-in socket 800 the socket lid 806 (FIG. 8B) is separate from the socket base 802 (FIG. 8A). No hinge connects the socket lid 806 to the socket base 802. In this embodiment reliable burn-in socket 800 a packaged integrated circuit may be plugged into the IC socket 804 in the socket base 802 and the socket lid 806 may then be clamped 814 (FIG. 8C) to the socket base 802 during burn-in reliability testing.

Electrical receptacles 812 in the lid 706 (FIG. 8B) are connected to the heater 808 to provide electrical power. Spring-loaded contact pins 810 built into in the socket base 802 may be connected to power and ground on the circuit board on which the burn-in socket base 800 is mounted. When the socket lid 806 is clamped 814 to the socket base 802 the spring-loaded contact pins 810 come into contact with the electrical receptacles 812 in the lid 806 and provide electrical power and ground to the heater 708. The spring-loaded contact pin 810 electrical connections in this embodiment avoid the use of flexible wires which may break. This burn-in socket design 800 also negates the need for a hinge which adds cost and is also subject to failure. This reduces the cost and manufacturing complexity of this embodiment reliable IC burn-in socket 800.

Figure 9A:
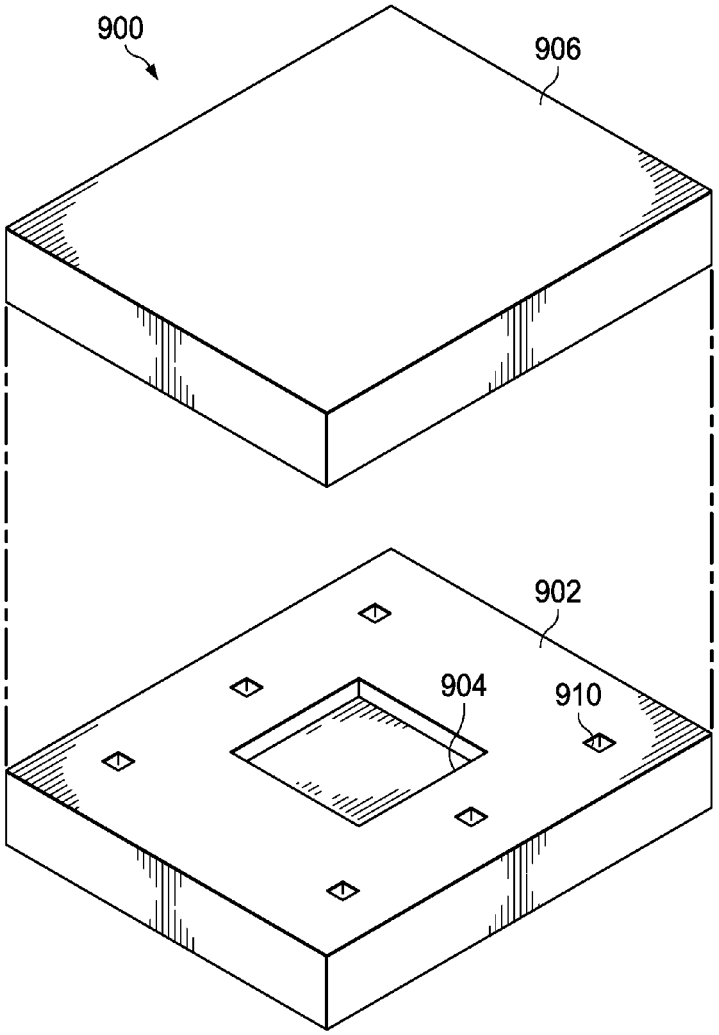
FIGS. 9A and 9B are views of an integrated circuit burn-in socket formed according to the principles of the disclosure and displayed in an open position.
Figure 9B:
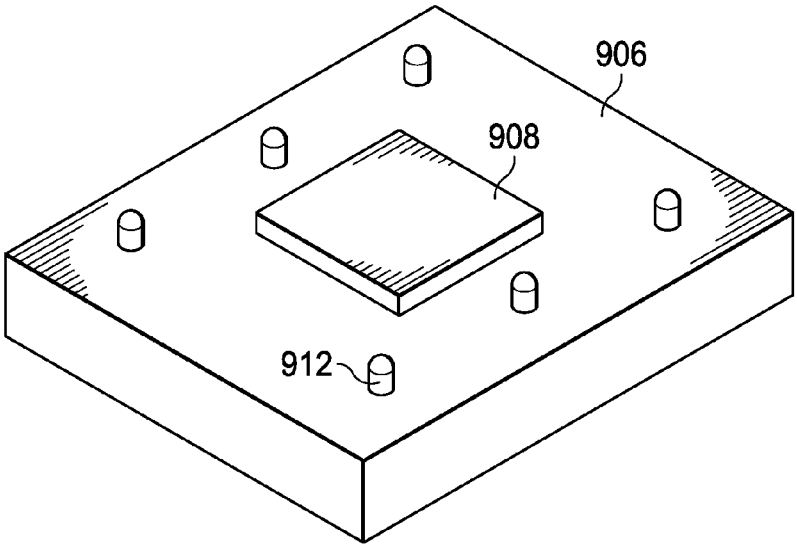

Another reliable burn-in socket 900 is illustrated in FIGS. 9A and 9B. This burn-in socket is similar to the burn-in socket illustrated in FIGS. 8A, 8B, and 8C except for the spring-loaded contact pins 912 are built into the socket lid 906 of the embodiment reliable burn-in socket 900 and the electrical receptacles 910 are built into the base 902.

In addition to be more reliable than the wire-based burn-in socket, the wire-free burn-in sockets also improve the efficiency of burn-in testing. In one implementation, for example, an array of socket lids may be mounted on a first board whereas a corresponding array of socket bases may be stationed on a second board. By engaging the first board and the second board, multiple socket lids and socket bases are mated simultaneously. When compared to the wire-based sockets, which are opened and closed individually, the wire-free sockets facilitate more efficient set-up and reset procedures.

While various embodiments of the present disclosure have been described above, it should be understood that they have been presented by way of example only and not limitation. Numerous changes to the disclosed embodiments can be made in accordance with the disclosure herein without departing from the spirit or scope of the disclosure. Thus, the breadth and scope of the present disclosure should not be limited by any of the above described embodiments. Rather, the scope of the disclosure should be defined in accordance with the following claims and their equivalents.

What is claimed is:

1. An integrated circuit socket, comprising:
- a socket base;
- a socket lid;
- a spring-loaded contact pin built into the socket base;
- an electrical receptacle built into the socket lid and configured to mate with the spring-loaded contact pin when the socket base contacts the socket lid; and
- a heater mounted on the socket lid wherein the heater is electrically coupled to the electrical receptacle.

2. The integrated circuit socket of claim 1, further comprising an integrated circuit socket in the socket base wherein the heater contacts a top surface of a packaged integrated circuit when the packaged integrated circuit is plugged into the integrated circuit socket and the burn-in socket is closed.

3. An integrated circuit socket, comprising:
- a socket base;
- a socket lid;
- a hinge connecting the socket lid to the socket base;
- a spring-loaded contact pin built into the socket base;
- an electrical receptacle built into the socket lid and configured to mate with the spring-loaded contact pin when the socket lid contacts the socket base; and
- a heater mounted on the socket lid wherein the heater is electrically coupled to the electrical receptacle.

4. The integrated circuit socket of claim 3, further comprising:
- an integrated circuit socket in the socket base wherein the heater contacts a top surface of a packaged integrated circuit when the packaged integrated circuit is plugged into the integrated circuit socket and the burn-in socket is closed.

5. An integrated circuit socket, comprising:

a socket base;

a socket lid;

a clamp configured to clamp the socket lid to the socket base;

a spring-loaded contact pin in the socket base;

an electrical receptacle in the socket lid and configured to mate with the spring-loaded contact pin when the socket lid is clamped to the socket base; and a heater mounted on the socket lid wherein the heater is electrically coupled to the electrical receptacle.

6. The integrated circuit socket of claim 5, further comprising an integrated circuit socket in the socket base wherein the heater contacts a top surface of a packaged integrated circuit when the packaged integrated circuit is plugged into the integrated circuit socket and the socket lid is clamped to the socket base.

7. An integrated circuit socket, comprising:

a socket base;

a socket lid;

a spring-loaded contact pin built into the socket lid;

an electrical receptacle built into the socket base configured to mate with the spring-loaded contact pin when the burn-in socket is closed; and a heater mounted on the socket lid wherein the heater is electrically coupled to the spring-loaded contact pin.

8. The integrated circuit socket of claim 7, further comprising an integrated circuit socket in the socket base wherein the heater contacts a top surface of a packaged integrated circuit when the packaged integrated circuit is plugged into the integrated circuit socket and socket lid is clamped to the socket base.

* * * * *